United States Patent [19]

Keuch

[11] 4,397,157

[45] Aug. 9, 1983

[54] SYSTEM FOR CONDITIONING AIR OF AN INTERNAL SPACE

[75] Inventor: Deane R. Keuch, White Plains, N.Y.

[73] Assignee: Sure Air Limited, New York, N.Y.

[21] Appl. No.: 151,135

[22] Filed: May 19, 1980

Related U.S. Application Data

[63] Continuation of Ser. No. 756,468, Jan. 3, 1977, abandoned, and Ser. No. 944,180, Sep. 21, 1978, abandoned.

[51] Int. Cl.[3] ..... F25B 25/00; F25B 29/00

[52] U.S. Cl. ..... 62/180; 62/332; 165/16

[58] Field of Search ..... 236/49; 165/16, 28; 62/213, 410, 186, 180, 332

[56] References Cited

U.S. PATENT DOCUMENTS 2,258,021 10/1941 Locke ..... 165/16

2,332,730 10/1943 Kucher ..... 62/186 X

*Primary Examiner*—William E. Wayner

*Attorney, Agent, or Firm*—Howard C. Miskin

[57] ABSTRACT

An internal space air conditioning system includes supply and return ducts communicating with the internal space, a blower circulating air through the ducts and space and a refrigeration unit having evaporator cooling coils located in the air path proximate the blower suction end. The return duct communicates with the ambient atmosphere by way of a louver type damper and thermostats are disposed in the internal space and the atmosphere, and are each actuated and deactuated respectively when the corresponding temperature exceeds and is below a preset value, the external set value being at least 10 degrees F. less than the internal set value. A control network is provided to fully close the damper, actuate the refrigeration unit and energize the blower when both thermostats are actuated, fully open the damper, deactuate the refrigeration unit and energize the blower when the internal and external thermostats are respectively actuated and deactuated and deactuate the refrigeration unit and de-energize the blower when the internal thermostat is deactuated. With an open damper and energized blower the ratio of return air to externally drawn air is about 1:1.

9 Claims, 4 Drawing Figures

HEATER
CONTROL NETWORK
SELECTOR SWITCH
EXTERNAL THERMOSTAT
INTERNAL THERMOSTAT
M1
M2
M3
M

SYSTEM FOR CONDITIONING AIR OF AN INTERNAL SPACE

This is a continuation of application Ser. No. 756,468 filed Jan. 3, 1977 and application Ser. No. 944,180, filed Sept. 21, 1978, both of which are now abandoned.

BACKGROUND OF THE INVENTION

The present invention relates generally to improvements in air conditioning systems and it relates more particularly to an improved air conditioning system of the type employing a refridgeration unit, external ambient air and recirculated air.

In the air conditioning cooling of internal spaces such as buildings and other structures of a commercial, industrial or domestic nature, it is conventional to employ a heat pump or air conditioning unit and recirculate the internal air past the air conditioning unit cooling by means of a blower and suitably positioned return and supply ducts. The air conditioning unit is actuated and deactuated in response to the internal temperature so as to operate whenever such temperature exceeds an adjustable preset value. The air conditioning unit is a highly energy-consuming device so that its operation is very expensive and any expedient employed in reducing the operating time of the air conditioning unit is highly desirable in that it reduces the operating costs. One such expedient which has been heretofore proposed depends on the use of the ambient atmospheric air when it is sufficiently cool to assist in the cooling of the internal space by drawing the air from the ambient atmosphere and circulating it through the internal space, while dampering off return air. Built up space pressure must then be relieved by a separate control device. While this expedient contributes to a significant reduction in energy consumption, the apparatus required is highly complex, bulky, expensive, often unfeasible, and otherwise leaves much to be desired.

SUMMARY OF THE INVENTION

It is therefore a principal object of the present invention to provide an improved air conditioning system.

Another object of the present invention is to provide an improved system for air conditioning internal spaces employing refridgerated as well as an ambient external air under preset conditions.

Still another object of the present invention is to provide an improved internal space air conditioning system in which energy consumption is greatly reduced by automatically circulating the external ambient air through the internal space when such external air is below a predetermined temperature.

A further object of the present invention is to provide a system of the above nature characterized by its high reliability and efficiency, very low cost, ruggedness and simplicity, ease of installation, maintenance and servicing, and great versatility and adaptability.

The above and other objects of the present invention will become apparent from a reading of the following description taken in conjunction with the accompanying drawings which illustrate a preferred embodiment thereof.

In a sense, the present invention contemplates the provision of an improved system for air conditioning an internal space comprising supply and return ducts and a blower located in the ducts for drawing air from the internal space and recirculating said air through said supply duct back into the internal space, an air conditioning or refridgeration unit transferable between an actuated and deactuated condition and including a cooling coil located in the ducts, means including a damper transferable between fully open and fully closed positions providing for communication between the return duct and the external ambient atmosphere, a first thermostat transferable between actuated and deactuated conditions in response to the internal space temperature exceeding and being less than a predetermined value respectively, a second thermostat transferable between an actuated and deactuated condition in response to the ambient atmosphere temperature exceeding and being less than a second predetermined value respectively and control means responsive to the concurrent actuation of the first and second thermostats for actuating the air conditioning unit and closing the damper and responsive to the concurrent actuations of the first thermostat and deactuation of the second thermostat for deactuating the air conditioning unit and fully opening the damper.

In the preferred form of the improved system the damper is in the form of a flat multilouver opposed blade gate which is motivated by a small motor between fully open and fully closed position under the control of the second thermostat. The control means also automatically controls the blower to actuate and deactuate the blower in response to the actuation and deactuation of the first thermostat and is provided with a manually operable switch for disabling the air conditioning unit and closing the damper and energizing the blower and a duct communicating heater unit. The thermostats are individually adjustable and the air conditioning unit, blower and damper are advantageously roof mounted. The ratio of the recirculated return to the ambient air drawn through the open damper with the blower running is between 1:1.5 and 1:0.5, advantageously about 1:1.

The improved air conditioning system is rugged, simple, efficient and reliable, easy to install, maintain and service, and of great versatility and adaptability.

DESCRIPTION OF THE PREFERRED EMBODIMENT

Figures 1, 2, 3, 4:
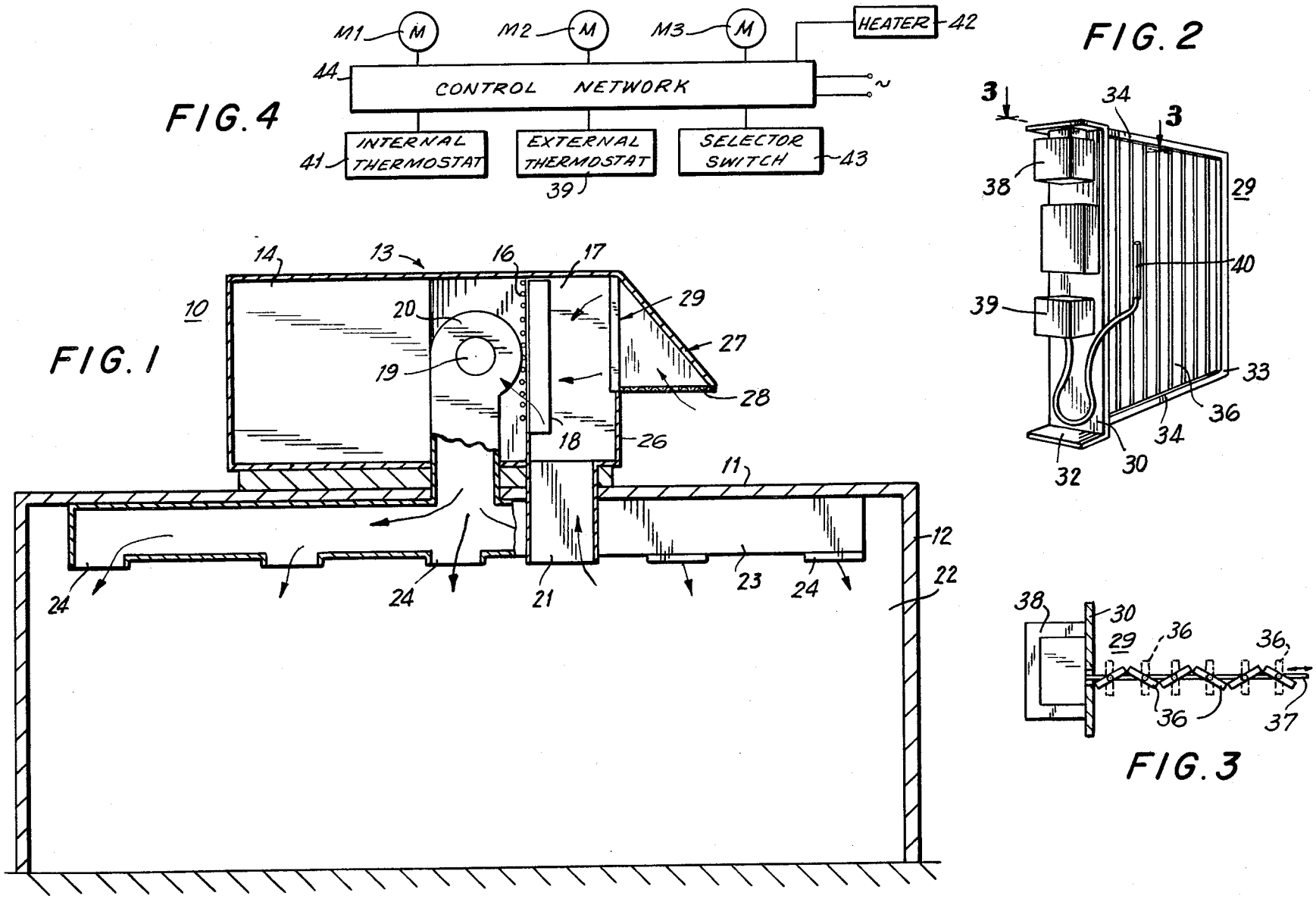
FIG. 1 is a vertical longitudinal sectional view of an air conditioning system embodying the present invention.
FIG. 2 is a perspective view of an ambient air damper forming part of the improved system.
FIG. 3 is a sectional view taken along line 3—3 in FIG. 2.
FIG. 4 is a block diagram of the air conditioning system control network.

Referring now to the drawings which illustrate a preferred embodiment of the present invention, the reference numeral 10 generally designates the improved air conditioning which is illustrated mounted on the roof 11 of a building or other enclosed space 12 which may be of an industrial, commercial, domestic or other type. It is to be understood, however, that the air conditioning system 10 may, if desire, be otherwise related to the building 12 than mounted on the roof thereof.

The refridgeration and air circulation section 13 of the air conditioning system 10 is of generally known construction and operation and may be a previously installed structure which is subsequently modified in accordance with the present invention. The section 13 comprises a refrigeration unit including a refrigerant compressor driven by an electric motor M1, a suitably cooled condensor, an evaporator cooling coil 16 and other conventional accessories. The cooling coil 16 is located across the outlet of a return air plenum chamber 17 which communicates with the section inlet 19 of an air blower 20 which is driven be an electric motor M2. Advantageously, a filter 18 is positioned across the outlet of chamber 17. The bottom of the plenum chamber 17 communicates by way of a return air duct network with one or more air return registers in the building internal space 22. The outlet of the blower 20 communicates by way of an air supply duct network 23 to outlet registers 24 suitably located throughout the internal space 22. Thus, the blower 20, when driven, circulates air from internal space 22 through return ducts 21 and plenum chamber 17 across the cooling coils 16 and back to the internal space by way of supply ducts 23.

In accordance with the present invention, a large rectangular part is formed in the outer wall 26 of the plenum chamber 17 opposite to the cooling coil 16 and blower inlet 19 and communicates with the external or ambient atmosphere by way of a hood 27 having a downwardly directed opening covered by a highly perforate bird screen 26. A louver type damper 29 of rectangular configuration registers with the part between the plenum chamber 17 and the hood 27.

The damper 29 includes a vertical mounting or bracket plate 30 engaging a vertical side edge of the ambient air port and terminating at its top and bottom in outwardly projecting horizontal flanges 32. Coinciding with the ambient air port and mounted to the bracket plate 30 is a rectangular frame 33 including top and bottom horizontal parallel legs 34. Extending between and pivotally supported by the frame legs 34 are opposed blade vertical slot-shaped louvers 36 which are rotatable about their medial vertical axes between closed overlapping positions as shown by the solid line in FIG. 3 and parallel open positions approximately 90 degrees from their closed positions, as shown by broken line in FIG. 3. An elongated actuating link 37 is eccentrically coupled to an end edge of the louvers 36 so that a longitudinal movement of the link 37 along its length between extended and retracted positions effects the respective closing and opening of the louvers 36 and hence, the damper 29. Advantageously, opposed blade louvers are used instead of parallel blade louvers to provide a high degree of control.

A low power electric motor M3 is housed in a casing 38 mounted on the upper outside face of bracket plate 30 and is coupled by a speed reducing transmission and a rotary to linear motion translator to the inner end of the link 37 which projects through an opening in the bracket plate 30. Thus, by suitable energization of the motor M3 the link 37 is fully advanced or retracted to close or open the louvers 36.

Also mounted on the bracket plate 30 is an external switch type thermostat 39 which is controlled by a remote sensing bulb 40 disposed along the outside face of damper 29 and exposed to the ambient atmosphere and is coupled to the thermostat switch 39. The temperature at which the thermostat 39 which is of conventional construction responds; that is, is actuated or deactuated, is manually adjustable, and is preferably set at about 60 degrees F.

There is also provided an internal thermostat 41 which is suitably located in the internal space 22 and is manually adjustable to respond to different preset temperatures at which it is actuated and deactuated and is normally set at about 75 degrees F. A heating device 42 of conventional construction 42 is located in the known manner in the path of flow of air through the circulating ducts and its energization is controlled by the internal thermostat 41 and a selector switch 43 which alternatively enables the refridgeration unit or heating device and disables the other.

A control network 44 which may be of the relay or semi-conductor type, as for example the models SDCR and 4PDT-R manufactured by Trol-A-Temp Corporation of Kenilworth, N.J., is provided and is connected to a source of current. The motors M1, M2 and M3 and the heater 42 are connected to the controlled outputs of the network 44 and the internal thermostat 41, external thermostat 39 and selector 43 are connected to the control inputs of the network 44.

The structure of the control network 44 which, in view of the following, is clear to one skilled in the art, is such that, with the selector switch set to cool position, when the external temperature is above the external thermostat set response temperature, for example 60 degrees F., the damper motor M3 is energized sufficiently to fully close the damper louvers 36 by means of link 37, and the compressor motor M1 and blower motor M2 are together energized and deenergized with the actuation and deactuation respectively of the internal thermostat 41 as the internal temperature exceeds and falls below the response value of the internal thermostat 41. On the other hand, when the external or ambient air temperature falls below the response temperature of the external thermostat 39, for example, below 60 degrees F., the refrigeration unit compressor motor M1 is disable and deenergized independently of the internal temperature and the blower motor M2 is energized and deenergized as the internal temperature exceeds and falls below the response temperature respectively of internal thermostat 41 and the energization of the motor M3 is so controlled as to effect the opening and closing of the damper louvers with the energization and deenergization respectively of the blower motor M2. When the selector switch 43 is transferred to a heat position, the motor M3 is so energized, so as to close the damper slat 36, the energizing circuit of compressor motor M1 is disabled or open and the heating device and blower motor M2 together are energized and deenergized as the internal thermostat is deactuated and actuated respectively in response to the internal temperature falling below or rising above the internal thermostat preset response temperature, for example, 75 degrees F. The selector switch 43 is normally set to the heating position when the external temperature is below about 40 degrees F.

The application and operation of the improved system are clear from the above. When it is set at its cooling cycle and the ambient temperature is sufficiently low, the time of operation of the compressor motor and hence, the energy consumption is greatly reduced and the overall efficiency increased. Further, the damper device 29 and its controls are of such simple construction as to be easily installed in existing air conditioning systems and the cost of such installations is rapidly amortized by the savings in energy consumption, normally in less than two years.

While there has been described and illustrated a preferred embodiment of the present invention, it is apparent that numerous alterations, omissions and additions may be made without departing from the spirit thereof.

I claim:

1. A system for air conditioning an internal space comprising a multiple outlet supply duct, a return duct, a blower for drawing air form said internal space through said return duct and recirculating said air through said supply duct to said internal space, an air conditioning unit transferable between an actuated and deactuated condition and including a cooling element located in the path of said circulating air through said ducts, means including a damper transferable between alternative fully open and fully closed positions providing communication between the ambient atmosphere and said return duct, a first thermostatic switch transferable alternatively on to a fully actuated or a fully deactuated condition in response only to the temperature in said internal space exceeding and being less than a first predetermined value respectively, a second thermostatic switch transferable alternatively only to a fully actuated or a fully deactuated condition in response only to the temperature of said ambient atmosphere exceeding and being less than a second predetermined value respectively and control means responsive only to the actuation of said first and second thermostatic switches for actuating said blower and air conditioning unit and fully closing said damper and responsive only to the actuation of said first thermostatic switch and the deactuation of said second thermostatic switch for deactuating said air conditioning unit and actuating said blower and fully opening said damper.

2. The system of claim 1 wherein said air conditioning unit blower and damper are located externally of said internal space.

3. The system of claim 2 including a roof disposed above said internal space, said air conditioning unit, blower and damper being mounted on said roof.

4. The system of claim 1 wherein said control means is responsive only to the actuation of said second thermostatic switch and the deactuation of such first thermostatic switch for actuating said air conditioning unit and blower and fully closing said damper and is responsive only to the deactuation of said first and second thermostatic switches for deactuating said blower and air conditioning unit and closing said damper.

5. The system of claim 3 wherein said return duct has an inlet port formed therein communicating with said ambient atmosphere and said damper comprises a multiple louver gate in which the louvers are swingable between open open parallel positions and closed positions.

6. The system of claim 3 wherein said return duct is in continuous open communication with said internal space.

7. The system of claim 6 wherein the ratio of return air from said internal space and the air drawn from said ambient atmosphere during the open condition of said damper is between 1:1.5 and 1:0.5.

8. The system of claim 7 wherein said ratio is approximately 1:1.

9. The system of claim 5 wherein the louvers when in closed position are opposed.

* * * * *